US005695367A

United States Patent [19]

Takano et al.

[11] Patent Number: 5,695,367

[45] Date of Patent: Dec. 9, 1997

[54] CONNECTOR ATTACHMENT COMPONENT

[75] Inventors: Tsunesuke Takano; Kouichi Sinzawa, both of Tokyo, Japan

[73] Assignee: Daiichi Denso Buhin Co., Ltd., Japan

[21] Appl. No.: 520,782

[22] Filed: Aug. 29, 1995

[30] Foreign Application Priority Data

| | | | |
|---|---|---|---|
| Sep. 30, 1994 | [JP] | Japan | 6-262107 |
| Oct. 5, 1994 | [JP] | Japan | 6-266350 |

[51] Int. Cl.[6] ..... H01R 17/00

[52] U.S. Cl. ..... 439/699.2

[58] Field of Search ..... 439/699.2, 356, 439/699.1, 56

[56] References Cited

U.S. PATENT DOCUMENTS

| | | | |
|---|---|---|---|
| 4,418,973 | 12/1983 | Smetana et al. | 439/699.2 |
| 5,035,643 | 7/1991 | Forish et al. | 439/699.2 |
| 5,078,625 | 1/1992 | Anzai | 439/699.2 |
| 5,558,543 | 9/1996 | Tanako et al. | 439/699.2 |
| 5,597,329 | 1/1997 | Takano et al. . | |

FOREIGN PATENT DOCUMENTS

| | | |
|---|---|---|
| 40 22 876 C2 | 1/1991 | Germany . |
| 41 13 559 A1 | 10/1991 | Germany . |
| 4-5082 | 4/1992 | Japan . |
| 2 235 832 | 3/1991 | United Kingdom . |
| 2 244 391 | 11/1991 | United Kingdom . |
| 2 270 804 | 3/1994 | United Kingdom . |
| 2 279 186 | 12/1994 | United Kingdom . |
| 2 287 141 | 9/1995 | United Kingdom . |

*Primary Examiner*—Khiem Nguyen
*Attorney, Agent, or Firm*—Nixon & Vanderhye, P.C.

[57] ABSTRACT

A connector for a wedge-base electrical component (e.g., a wedge-base bulb) includes an electrically insulative base and an electrically insulative holder attached to the base and defining an interior socket space therewithin for receiving the wedge-base of the electrical component. A pair of U-shaped electrically conductive clamp elements is positioned in the interior socket space of the holder. The U-shaped clamps resiliently hold the wedge-base of the electrical component and establish an electrical connection therebetween. Each of the clamp elements includes a connection piece for connection to a bus bar so as to establish an electrical circuit connection with the electrical component resiliently held by the clamp elements. The insulative holder includes a pair of opposed resilient support tabs extending upwardly from the holder so as to engage the electrical component at a location above the wedge-base of the electrical component. In such a manner, lateral support is provided to the electrical component when held within the holder by the support tabs.

5 Claims, 11 Drawing Sheets

CONNECTOR ATTACHMENT COMPONENT

FIELD OF INVENTION

The present invention relates to a connector attachment assembly that enables a heat resistant, insulated holder containing a wedge base bulb lamp or a flat fuse to be connected to a base member.

BACKGROUND AND SUMMARY OF THE INVENTION

One example of a conventional connector attachment assembly is described in Japanese Utility Model No. 4-5082. The conventional connector attachment component as described therein is used by engaging a block, on which a connector is mounted, with an attaching member. The attaching member itself comprises a generally rectangularly shaped insulating base frame, a plurality of locking tabs and flanges projecting from the side pieces of the insulating base, and two pairs of opposing pieces having narrow relief holes between each of the opposing pieces and formed from the inner surfaces on both sides of the side pieces in the base's lengthwise direction. A pair of projections project from the inside faces of these two pairs of opposing pieces, while two connectors, each of which is equipped with a pair of clamping pieces, form resilient U-shaped conductive strips. A plug-in receptacle is integrated into a single unit with attaching holes formed in the base of the clamping pieces of said two connectors. A connector assembly therefore has each of these two connectors mounted between the two pairs of opposing pieces by means of the pair of projections through the attaching holes. The attaching member defines an engaging hole slightly larger than the flat contour of the insulating base. Thus, the connector assembly is engaged with the attaching member through the engaging hole with the locking tabs and flanges.

In the prior art structure described above, since a U-shaped clamping piece is provided which projects to the inside of an insulating based in the form of a flat frame perpendicular to its flat surface, the conductive clamping piece protrudes from the upper surface of the insulating base. There are no electrically protective members around its periphery. Thus, when an external conductor (such a screwdriver or other tool) inadvertently makes contact with the clamping piece or the conducting portion of a lamp or glass fuse clamped in it during automobile repair or inspection, a short occurs thus resulting in the first disadvantage of causing a malfunction of equipment or damage to parts.

In addition, in the above-described prior art structures, since the lamp or fuse base is clamped with a clamping piece, there is nothing else that directly guards the lamp or fuse. When a relatively low-powered lamp is employed or the lamp bulb is largely protruding from the power supplying base, as in the manner of a wedge base bulb lamp, the base portion of the lamp is supported only the clamping piece. The lamp or fuse ends therefore have a tendency to be released from the clamping piece in the event of a large external force being applied to the clamping piece or external disturbances occurring, such as large vibrations applied to the clamping piece.

In order to eliminate each of the disadvantages described above, it would be desirable to ensure an inexpensive and reliable heat-resistant and insulating structure. Furthermore, it would be highly desirable to clamp a bulb or fuse securely and enable automation of installation of a connector to an attaching member of a holder by attaching a wedge base bulb or fuse to a non-heat-resistant member by means of a heat-resistant holder having good heat dissipation properties.

U.S. Pat. No. 5,597,329 which issued on Jan. 28, 1997 to the same inventors as that of the present application discloses a connector attachment component whereby the insulating holder, on which a connector is mounted, is integrally formed with an attaching member. However, since the insulating holder to which a connector is mounted uses an expensive, high-grade and heat-resistant plastic, the cost may be excessively high thus resulting in the need for improvements in terms of cost.

According to the present invention, there is provided a connector attachment assembly for a wedge-base electrical component. The connector attachment assembly includes an electrically insulative base, and an electrically insulative holder attached to the base and defining an interior socket space therewithin for receiving the sedge-base of the electrical component. A pair of U-shaped electrically conductive clamp elements is positioned in the interior socket space of the holder. The U-shaped clamps resiliently hold the wedge-base of the electrical component and establish an electrical connection therebetween. Each of the clamp elements includes a connection piece for connection to a bus bar so as to establish an electrical circuit connection with the electrical component resiliently held by the clamp elements. The insulative holder includes a pair of opposed resilient support tabs extending upwardly from the holder so as to engage the electrical component at a location above the wedge-base of the electrical component. In such a manner, lateral support is provided to the electrical component when held within the holder by the support tabs.

In the assembly of the invention, the holder and the base are most preferably separate components. Thus, only the body member may be made of expensive, high-grade and heat-resistant plastics material. Since inexpensive heat-resistant plastic can be used for the base, which uses a much larger amount of plastic than the holder, the cost of the overall assembly is less than that of the prior art. In addition, by providing U-shaped connectors totally within the insulated holder to extend between upper and lower opposing surfaces of the nearly square-shaped holder, there is little possibility of inadvertent contact by unnecessary external conductors (such as a screwdriver or other tool) with the connectors or with the electrically conducting portions of the lamp clamped in it during automobile repair or inspection, thus preventing the occurrence of accidents caused by short circuits.

Moreover, in the assembly of the present invention, since resilient tabs clampingly support the base portion of a lamp or fuse, even in the case of lamps in which the bulb largely protrudes from the power supplying base of the lamp in the manner of wedge base bulbs, the lamp or fuse is reliably and stably reinforced, thus enabling it to be used while being supported.

In the above-mentioned installation state, vertical movement of the holder with respect to the base is restricted as a result of the opposing edges of the locking tabs respectively making contact with the both the upper and lower surfaces of the base, thus preventing rattling, while horizontal movement of the holder is restricted by the edge of the engaging hole of the base.

Further advantages and aspects of this invention will become more clear after careful consideration is given to the detailed description of the preferred exemplary embodiments thereof which follow.

BRIEF DESCRIPTION OF THE DRAWINGS

By way of examples only, embodiments of the invention will now be described in greater detail with reference to the accompanying drawings wherein.

DETAILED DESCRIPTION OF THE PREFERRED EMBODIMENTS

Figure 1A:
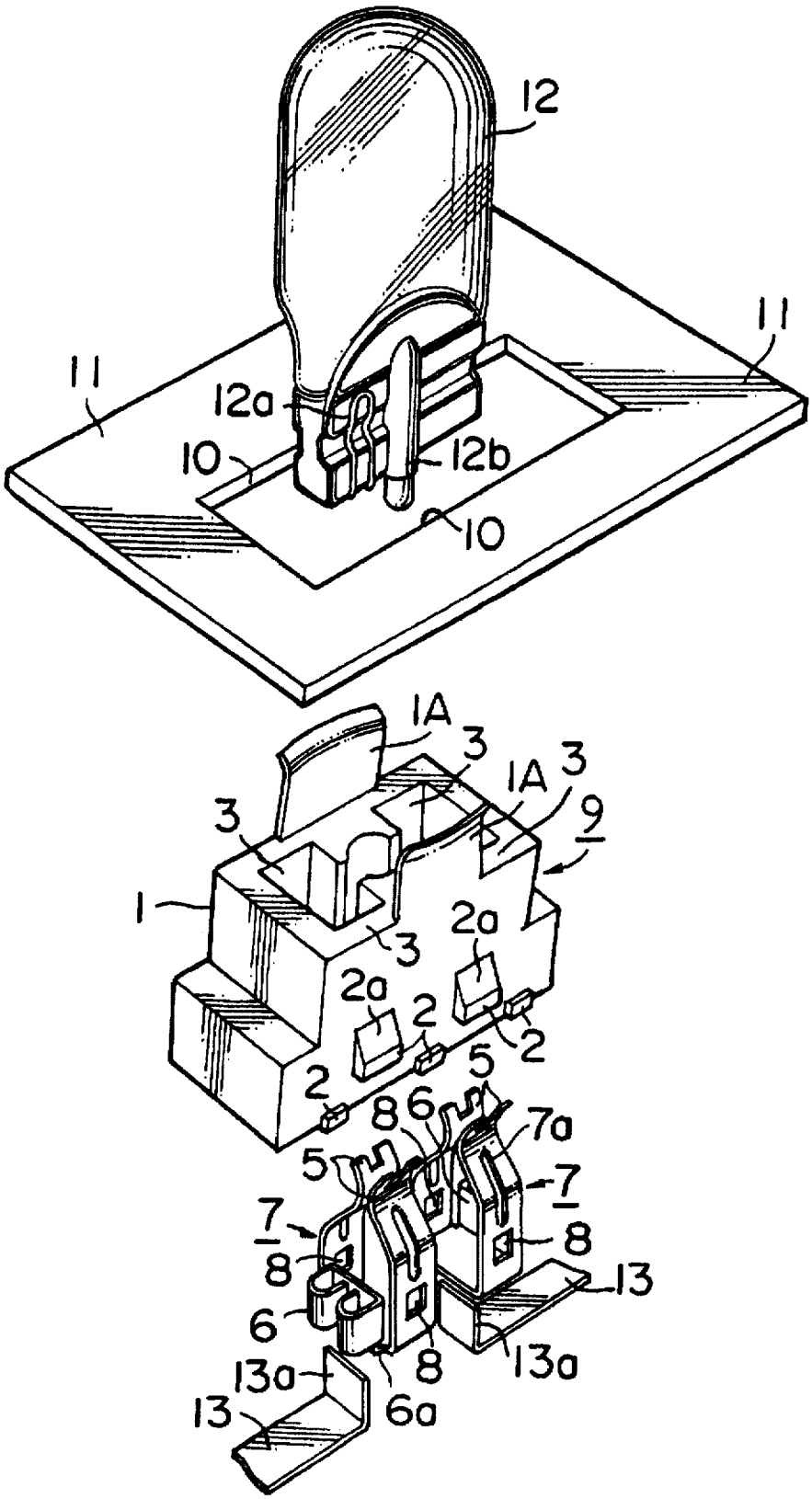
FIG. 1A is an exploded perspective view of the assembly of the present invention.

The basic components of the assembly of the present invention consist of an insulating holder in which are mounted electrical connectors, the holder being attached to a base. The holder includes a box-shaped holder 1 on which are formed locking tabs 2 and clamping support resilient tabs 1A protruding upwardly as shown in FIG. 1A, said tabs being formed by three-way open and close molding on both the left and right sides of the holder 1, said member 1 being of a heat resistant plastic such as Nylon 66.

Furthermore, although inclined surfaces 2a are formed as shown in FIG. 1 on the upper portions of the two upper locking tabs 2, such inclined surfaces may also be formed on the lower portions of the lower locking tabs 2.

Figure 3A:
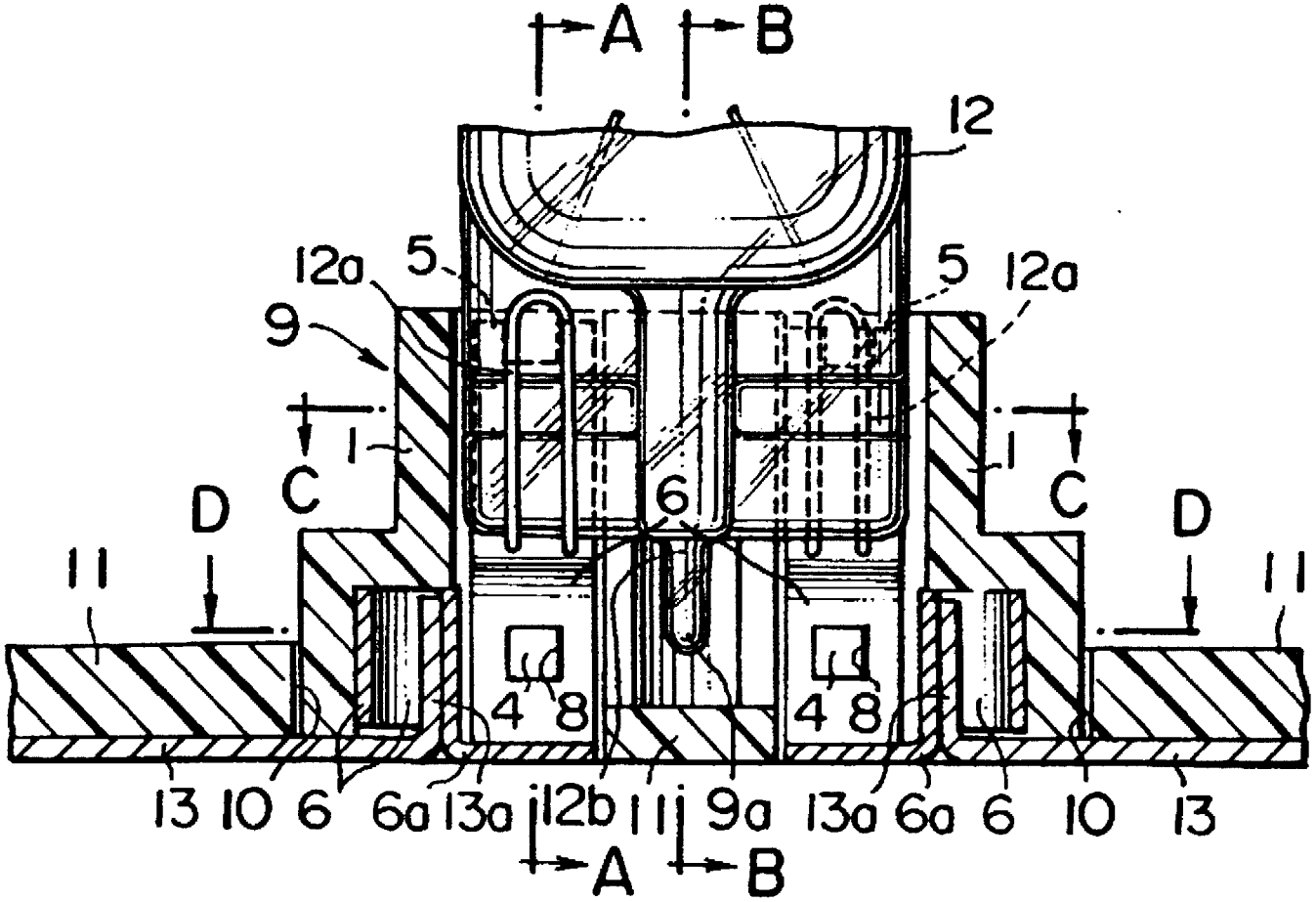
FIGS. 3A and 3B are vertical sectional side views of the central portion of the assembly shown in FIGS. 2A and 2B, respectively.
Figure 4A:
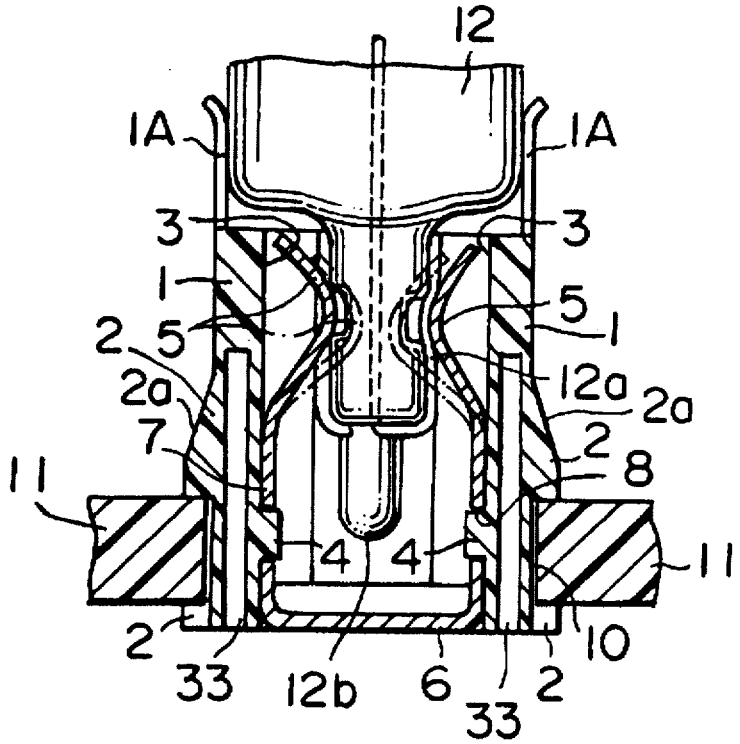
FIGS. 4A and 4B are cross-sectional views taken along line A—A of FIGS. 3A and 3B respectively.

Projections 4 are provided as shown in FIGS. 3A and 4A on one or both of the opposing internal surfaces of the holder 1 between opposing pieces 3 formed to both sides of the member 1 in the direction of the width thereof.

Figure 1B:
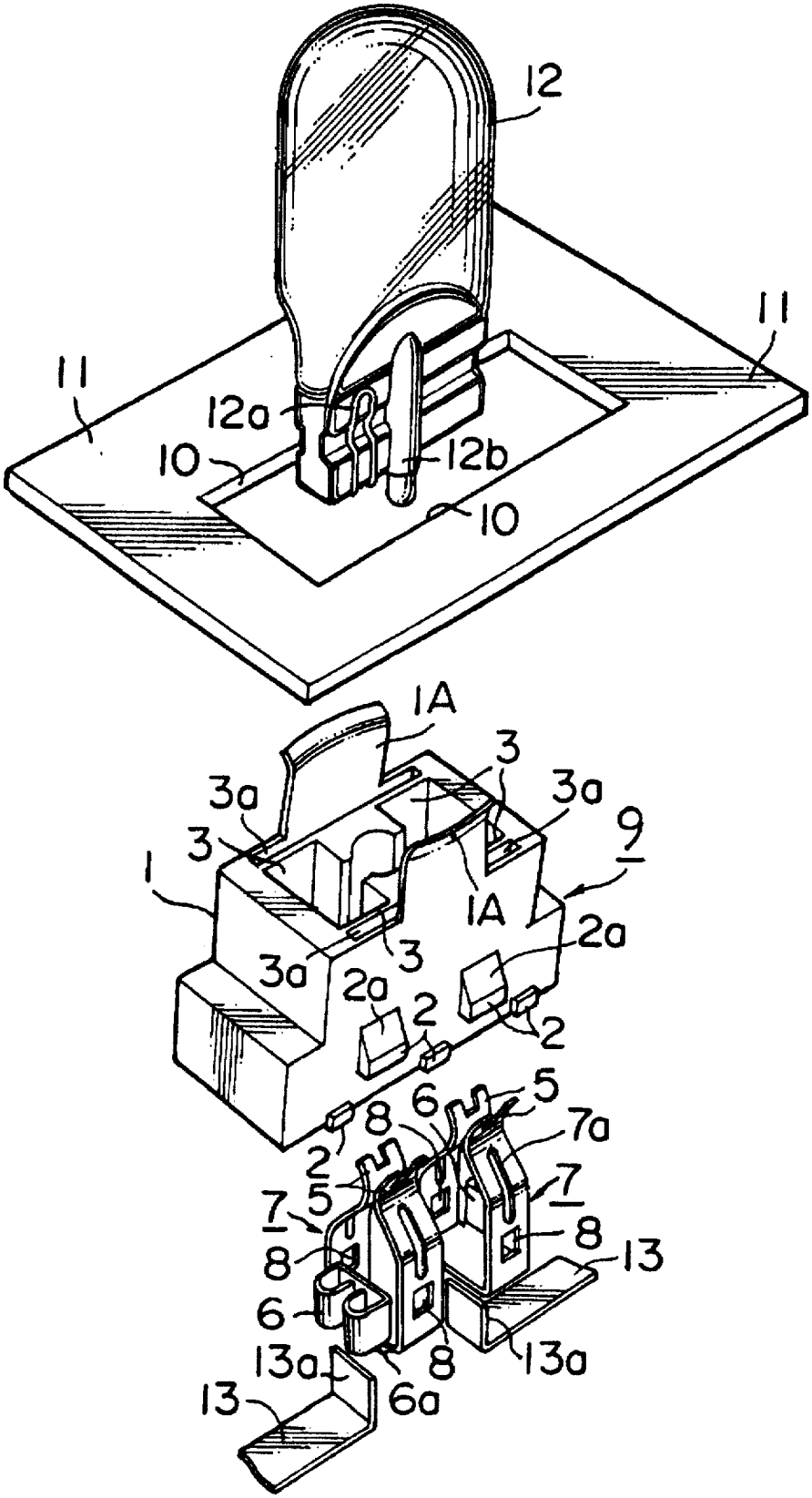
FIG. 1B is an exploded perspective view of a modified version of the assembly of FIG. 1A.
Figure 2A:
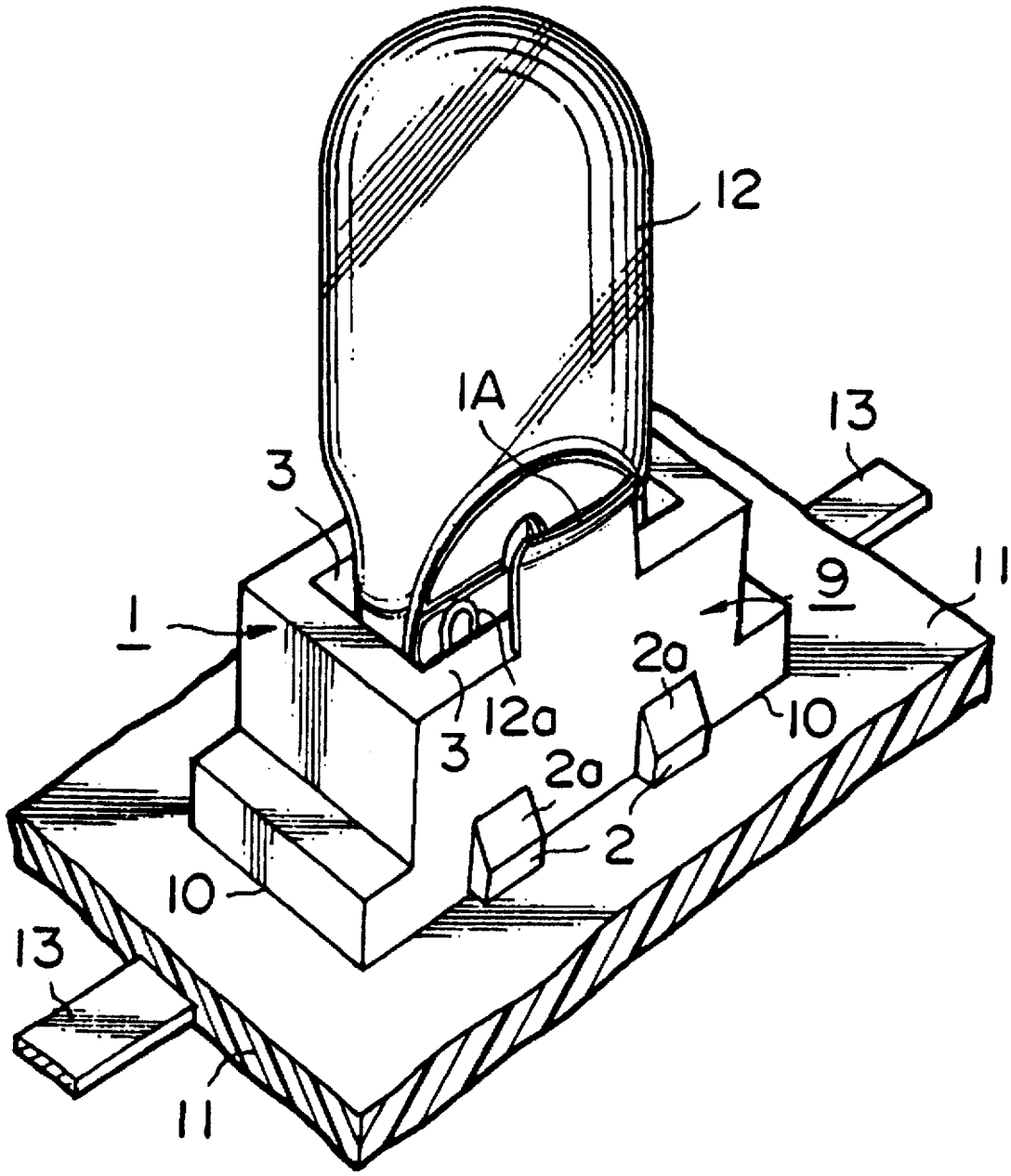
FIGS. 2A and 2B are perspective views after assembly of the assembly shown in FIGS. 1A and 1B, respectively.
Figure 2B:
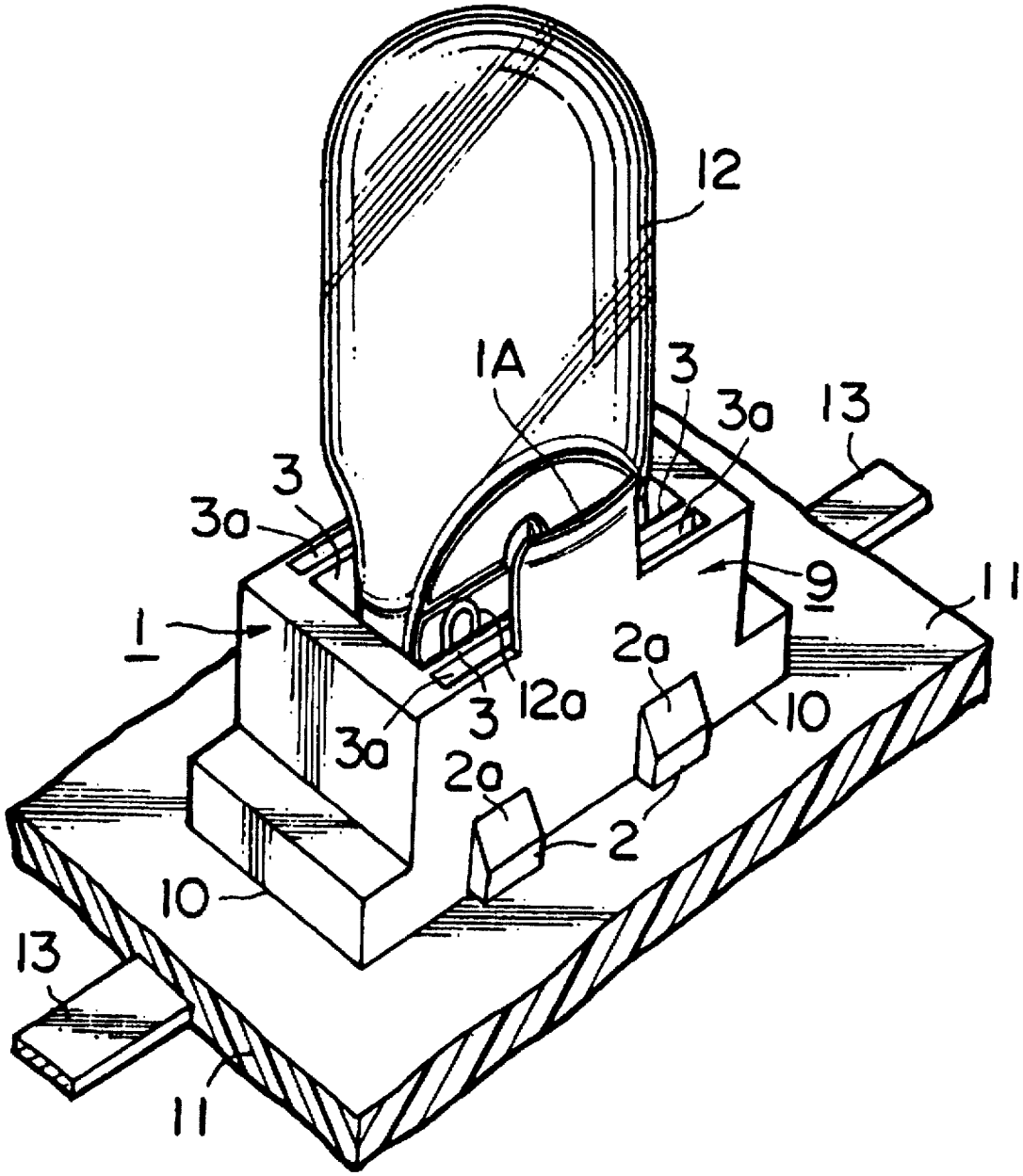
Figure 3B:
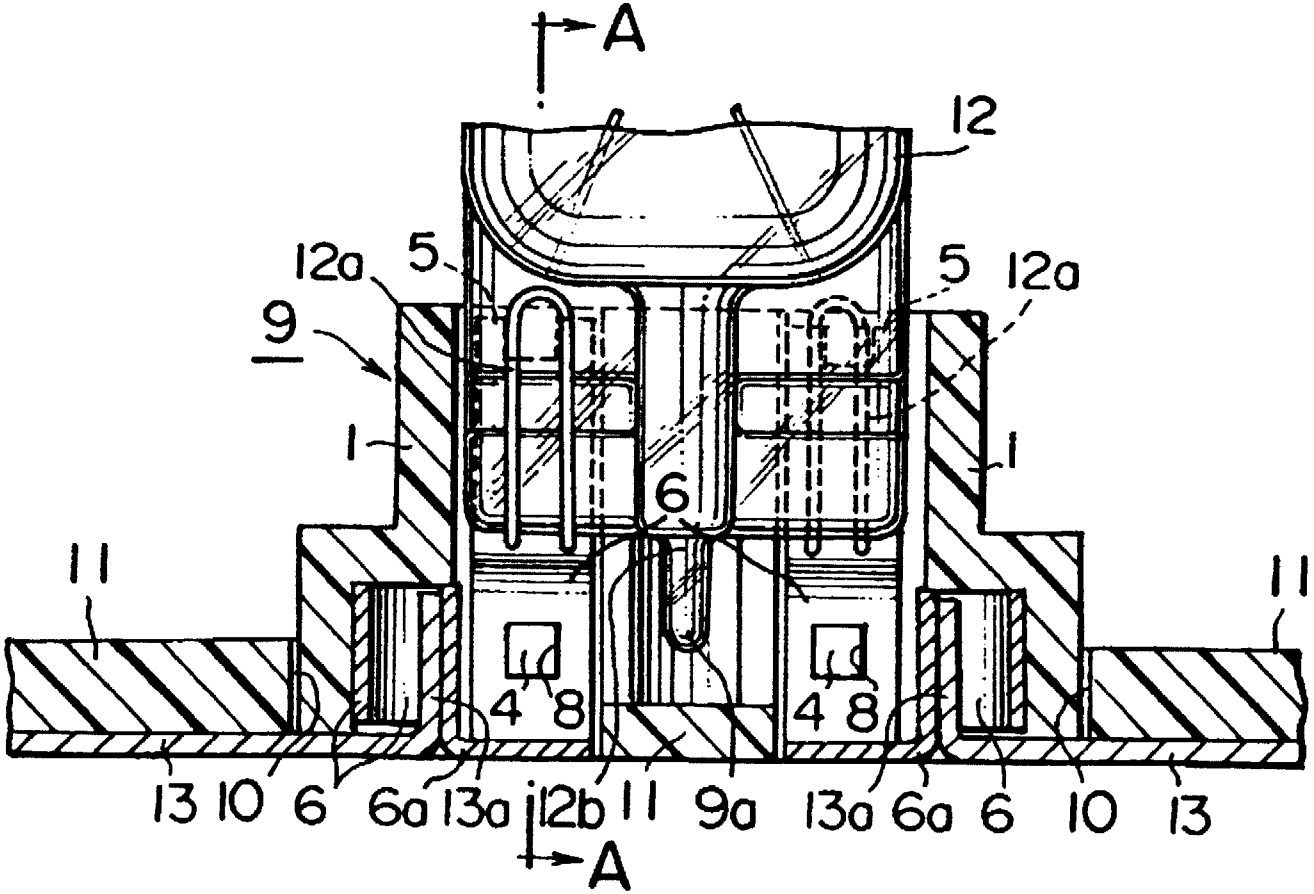
Figure 4B:
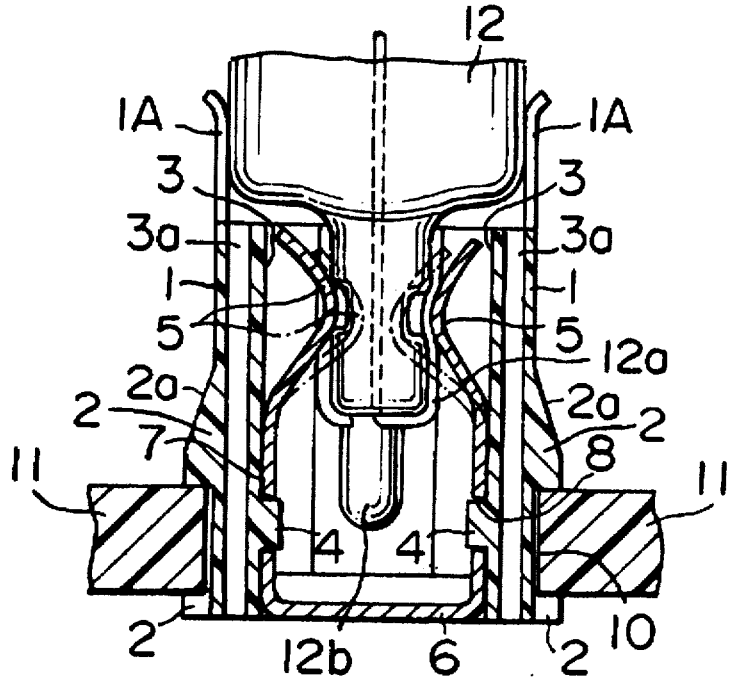

Similarly, projections 4 are provided as shown in FIGS. 3B and 4B on one or both of the opposing internal surfaces of the holder 1 between opposing pieces 3 formed to both sides of the member 1 in the direction of width thereof, and respectively containing side relief holes 3a on the inside of said sides as shown in FIGS. 1B and 4S.

In addition, two connectors 7, each consisting of resilient conductive strips of phosphor bronze or the like formed substantially into the shape of the letter "U" as shown in FIG. 1A, and each including a pair of clamping pieces 5 and an integral eyeglass-shaped plug-in receptacle 6 at the base thereof, are located in the above-mentioned holder 1 as shown in FIGS. 3A through 5. More particularly, after locating the above-mentioned pair of projections 4 into attachment holes 8 formed in the base of the clamping pieces 5 while pressing the upper portions of said clamping pieces 5 together in opposition to their resiliency, the upper portions of said clamping pieces 5 are released to return to their original state due to their resiliency, thus causing the connectors 7 to be installed between the opposing surfaces of the holder 1 to constitute a bulb holder 9 as shown in FIG. 4A.

Moreover, the above-mentioned bulb holder 9 is engaged as shown in each of the drawings from FIG. 2 to FIG. 7 with base 11 through an engaging hole 10 in said member 11 by utilizing the inclined surfaces 2a of the above-mentioned locking tabs 2, the hole 10 in the base 11 being slightly larger than the outer dimensions of the holder 1 as shown in FIG. 1A.

More particularly, when the upper or lower locking tabs 2 on the sides of the holder 1 are pressed between opposed edges of the engaging hole 10 in the base 11 utilizing their inclined surfaces 2a with said sides of the holder pushed towards each other in opposition to their resiliency, and on release of locking tabs 2 from the edges of the engaging hole 10, said sides of the holder 1 return to their original positions due to their resiliency, thus enabling bulb holder 9 to be easily attached to base 11 through its engaging hole 10 with a snapping action.

Figure 5:
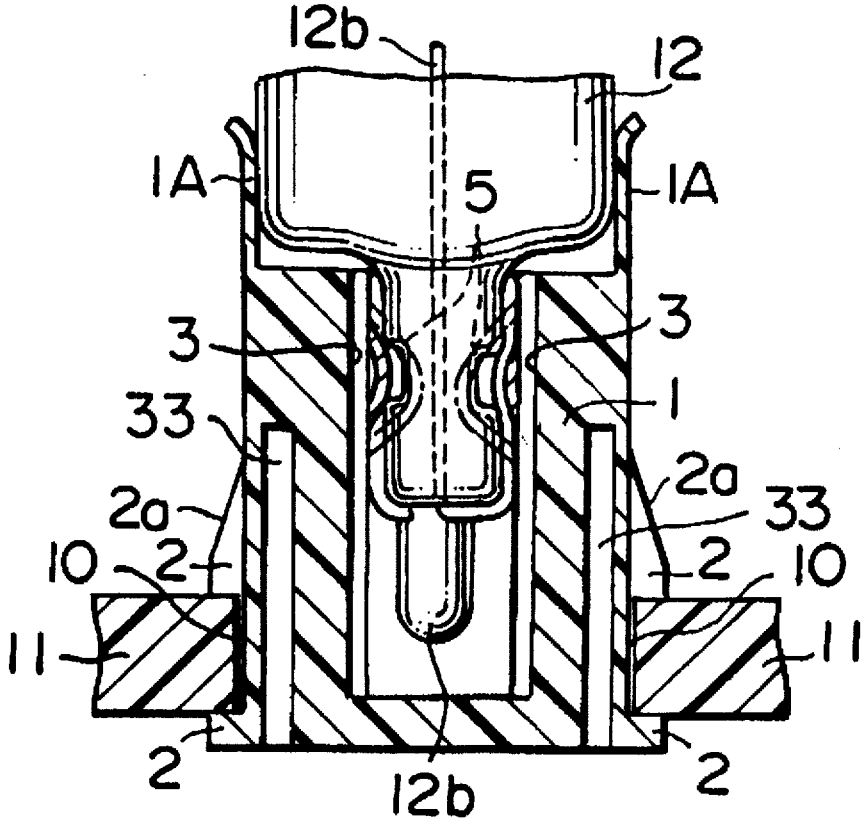
FIGS. 5, 6 and 7 are cross-sectional views taken along lines B—B, C—C and D—D, respectively, of FIG. 3A.
Figure 6:
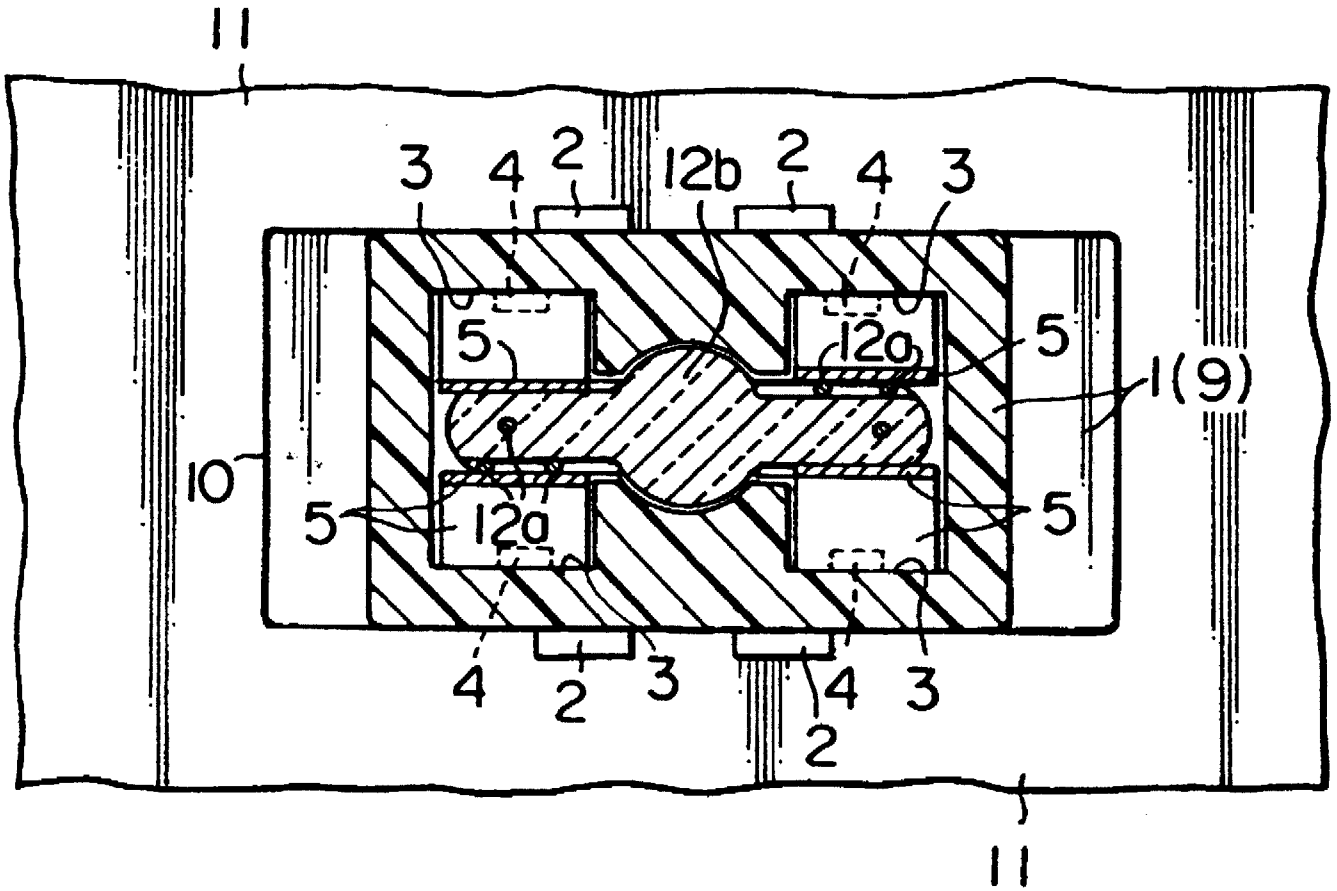
Figure 7:
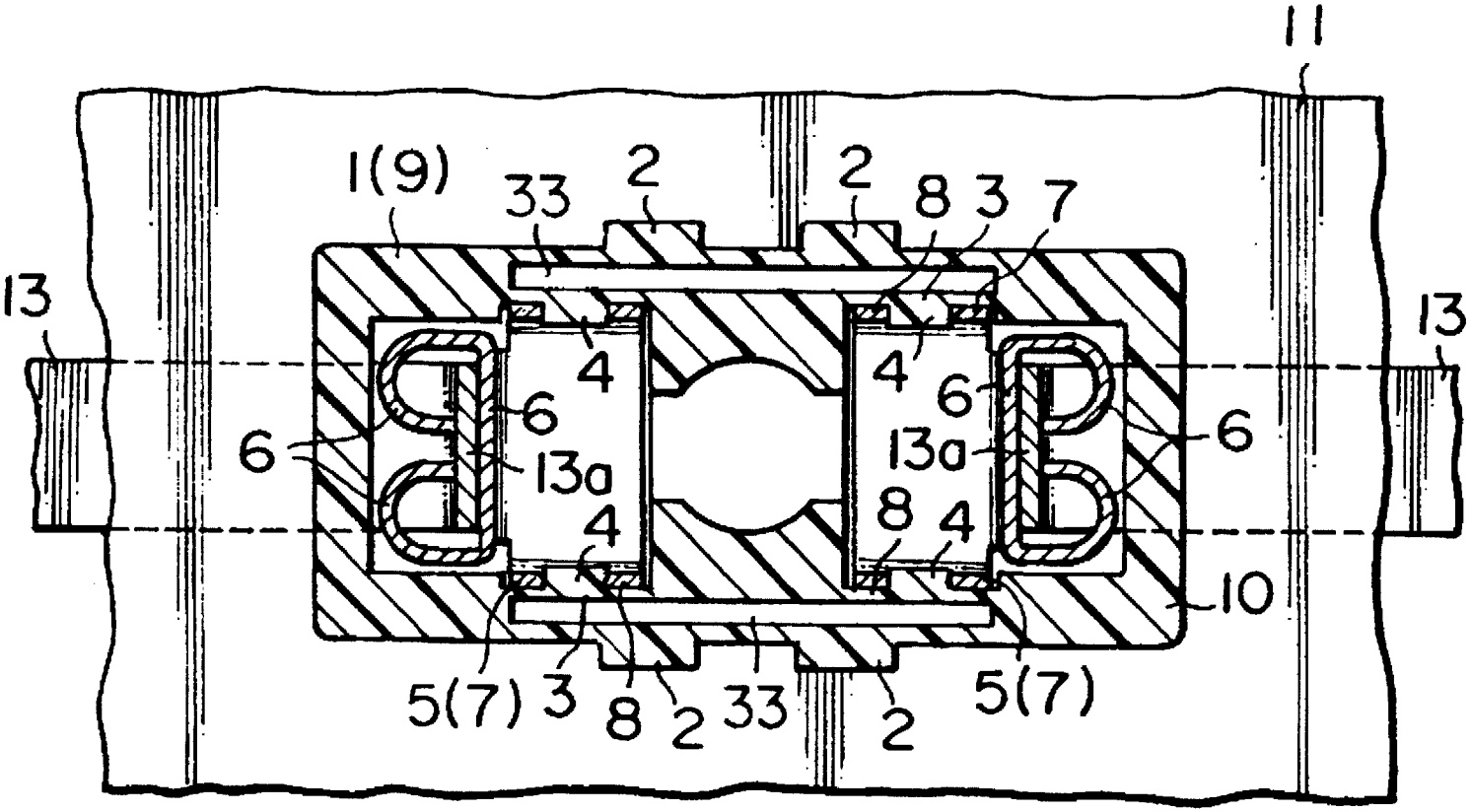
Figure 8:
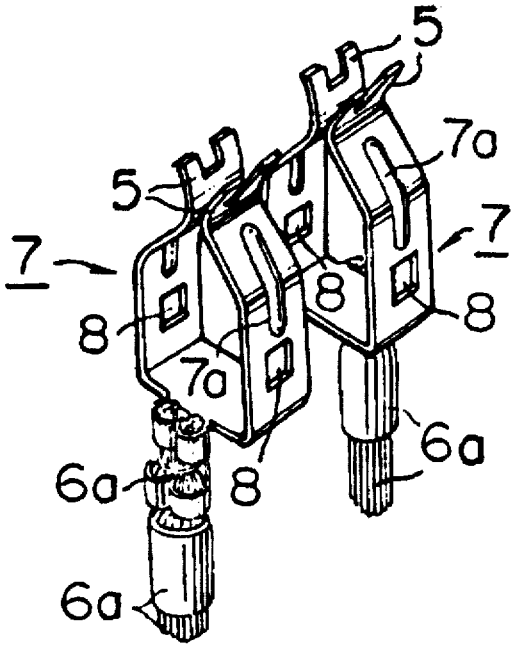
FIGS. 8 and 9 are perspective views showing other examples of connectors of the assembly according to the invention.
Figure 9:
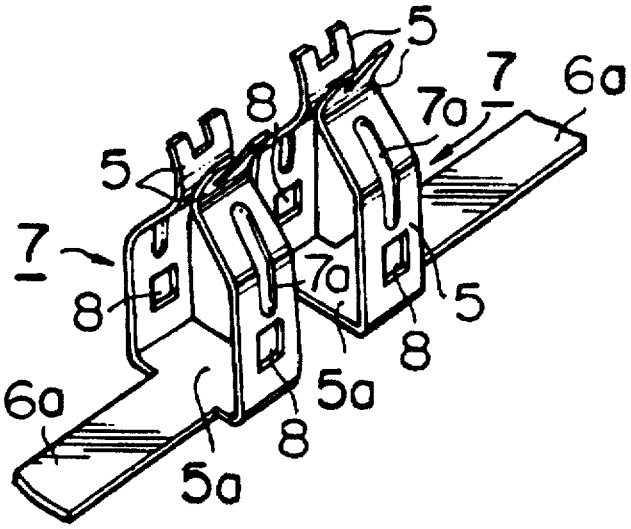

Furthermore, although the portions indicated with reference numeral 33 in FIGS. 4A, 5 and 7 are relief grooves to facilitate bending of the opposing pieces 3, such relief grooves 33 are unnecessary if the opposing pieces 3 are thin-walled. In addition, connectors 7 may he connected to a remote location by means of lead members 6a in the form of lead wires or bus bars as shown in FIGS. 8 and 9, instead of using the plug-in receptacles 6 integrally formed with the base portions of the clamping pieces 5 of the connectors 7.

The assemblies of FIGS. 1B, 2B, 3B, 4B are the same as those of FIGS. 1A, 2A, 3A, 4A but with the inclusion therein of side relief holes 3a.

The following provides an explanation of an example of use of the present invention.

A known wedge base bulb lamp 12 having a base 12b and provided with conductive lead portions 12a as shown in FIG. 1A is inserted into bulb holder 9 as shown in FIG. 4A as well as in FIGS. 3A and 5. As a result of inserting wedge base bulb lamp 12 until bulb base 12b makes contact with holder ledge 9a, the clamping pieces 5 of connectors 7 are pushed apart in opposition to their resiliency by the above-mentioned lead portions 12a of bulb 12, from the broken line position in FIG. 4A to the solid line position.

Next, when the bent portions 13a of bus bar 13, arranged to be aligned with the surface of the base 11 as shown in FIGS. 1A and 7, are snapped into the plug-in receptacles 6 of connectors 7, electrical continuity with the bulb 12 results and the wedge base bulb 12 can be lit.

A known type of flat fuse may be inserted instead of the abovementioned wedge base bulb 12, while inclined surfaces 2a of locking tabs 2 can be omitted in which case bulb holder 9 can be attached to base 11 through its engaging hole 10 by applying an external force to bend in the sides of the holder 1.

The present invention offers the following advantages.

Since the present invention provides clamping support resilient tabs 1A, which guard the base of a wedge base bulb or a flat fuse by clamping around it, these tabs 1A being integrally formed with, to protrude from, the upper portion of the holder 1, even when the bulb protrudes significantly from the power supplying base portion thereof, as in the case of wedge base bulbs, the bulb is reliably and stably reinforced whereby it is supported in use. This offers a first advantage of safety, in that the lamp or fuse does not come out of the assembly due to external disturbances such as vibrations.

In the present invention and as the holder 1 and the base 11 are separate components, the only component that requires the use of an expensive, high-grade and heat resistant plastic is the holder 1. Inexpensive heat-resistant plastic can be used for the base, which uses a much larger amount of plastic than the holder 1. Thus the present invention offers the advantage of less cost than that of the prior art.

Also in the present invention, when the outer surfaces of either the upper or the lower locking tabs 2 have an inclined surface and the sides of the holder 1 are pressed between the opposed edges of engaging hole 10 in the base 11 utilizing the inclined surfaces 2*a* of the tabs 2, and with the sides of the holder 1 pushed in the direction in which side relief holes 3*a* narrow in opposition to their resiliency, release of the locking tabs 2 from the edges of the engaging hole 10 results in said sides of the holder returning to their original position due to their resiliency, whereby bulb holder 9 can be easily and automatically attached to attachment body 11 through engaging hole 1*a* a snapping action. Further, in use, air cooling effects are created due to the radiator action of the side relief holes 3*a*, and, in the vertically installed condition shown in FIG. 3A, rising air currents are produced by chimney effects which result in good dissipation of the heat entering from the bulb or the fuse to the holder 1 and the bulb supporting resilient tabs 1A. Thus, thermal deformation of the bulb holder 9 can be prevented while, at the same time, ensuring safety, thereby providing further advantages.

As the present invention provides U-shaped clamping pieces 5 within the holder 1 extending between opposing upper and lower surfaces of the substantially square-shaped holder 1, and as the periphery of each conductor clamping piece 5 is surrounded by the holder 1, which is an electrically insulating member, there can be no inadvertent contact by external conductors (such as a screwdriver or other tool) with the clamping pieces 5 or with electrically conducting portions of the lamp clamped in the conductors 7 during automobile repair or inspection. Thus the occurrence of accidents caused by short circuits, as well as damage to equipment and parts, is prevented thereby providing a still further advantage.

What is claimed is:

1. A connector for a wedge-base electrical component comprising:

an electrically insulative base;

an electrically insulative holder attached to said base and defining an interior socket space therewithin for receiving the wedge-base of the electrical component; and a pair of U-shaped electrically conductive clamp elements positioned in said interior socket space of said holder for resiliently holding the wedge-base of said electrical component and establishing an electrical connection therebetween, said clamp elements each including a connection piece for connection to a bus bar so as to establish an electrical circuit connection with the electrical component resiliently held by said clamp elements; wherein said insulative holder includes a pair of opposed resilient support tabs extending upwardly from said holder so as to engage the electrical component at a location above the wedge-base of the electrical component so as to provide lateral support to the electrical component when held within said holder.

2. The connector as in claim 1, wherein said holder includes pairs of locking tabs for removably coupling the holder to the base.

3. The connector as in claim 2, wherein at least one of said locking tabs includes an inclined surface.

4. The connector as in claim 1, wherein said resilient support tabs are integrally formed with said holder.

5. The connector as in claim 1, wherein said holder includes a pair of side relief holes, each being adjacent to a respective one of said resilient support tabs.

* * * * *